United States Patent [19]

Hayes

[11] 4,239,477

[45] Dec. 16, 1980

[54] FURNACE IGNITION SYSTEM WITH DRAFT CONTROL AND LOSS-OF-DRAFT PROTECTION

[75] Inventor: Thomas E. Hayes, Goshen, Ind.

[73] Assignee: Johnson Controls, Inc., Milwaukee, Wis.

[21] Appl. No.: 959,765

[22] Filed: Nov. 13, 1978

[51] Int. Cl.[3] ..... F23N 3/00

[52] U.S. Cl. ..... 431/20; 236/1 G; 236/15 C

[58] Field of Search ..... 431/20; 236/1 G, 15 C; 126/285 B; 110/163

[56] References Cited

U.S. PATENT DOCUMENTS 2,155,642 4/1939 Dewey ..... 431/20 X

*Primary Examiner*—William E. Wayner

*Attorney, Agent, or Firm*—Emrich, Root, Lee, Brown & Hill

[57] ABSTRACT

A furnace ignition and draft control system includes a damper plate movable under control between a closed and an open position. When a call for heat signal is generated, a holding relay is actuated to energize a damper motor to open the damper provided the damper plate was closed when the signal was generated, otherwise the system will not operate. After the damper is run to the full open position and this is proved, a fuel control circuit is actuated to supply fuel to the furnace, and a trial-for-draft period is initiated. A draft controller energizes the damper motor to open the damper if draft is less than a first predetermined value and to close the damper if draft is greater than a second predetermined value. The predetermined draft values define a desired draft range in which the damper is not operated. If a draft greater than the second value is sensed within the trial period, the draft controller partially closes the damper to control the draft value within the desired draft range, otherwise the system locks out at the end of the trial period. If draft is lost at any time, the controller moves the damper to the open position and a loss-of-draft safety timing period commences. If draft is not reestablished during this period, the system shuts off the fuel and locks out. If the call for heat is satisfied, the system closes the damper and is prepared for another operating cycle, having tested the operativeness of all major components without failure. Any failure would have locked the system out.

8 Claims, 2 Drawing Figures

FURNACE IGNITION SYSTEM WITH DRAFT CONTROL AND LOSS-OF-DRAFT PROTECTION

BACKGROUND AND SUMMARY

The present invention relates to furnace ignition systems in general; and in particular, it relates to an ignition system for a fuel-burning appliance which eliminates the need of a conventional draft hood. Not only does the present invention perform the functions of a conventional draft hood, but it also provides a stack damper when the appliance is off, controls the value of draft while the appliance is operating, and provides loss-of-draft safety by shutting off the source of fuel if draft is lost and cannot be re-established within a predetermined time after the damper has been driven to the full open position.

Draft hoods have been used in combination with gas-fired appliances such as furnaces, water heaters, and the like for many years. A draft hood is a fitting which is normally located in the flue pipe leading from the appliance to the vent stack, or in the stack itself, which vent the combustion products from the fire box of the appliance to a chimney.

A draft hood serves a number of purposes in an installation of this type. In the case of a down draft or stoppage anywhere in the flue or stack beyond the draft hood, it permits the escape of combustion products into the ambient. A draft hood also neutralizes the effect of stack action of the chimney on the operation of the appliance by drawing air from the ambient and exhausting it through the chimney when the appliance is first fired.

Even though draft hoods have long been known to constitute a major heat loss to the outside, both when the furnace is being fired and when it is not, nevertheless, they have been widely used because of the relatively low cost of fuel and because any alternative, particularly in residential usage, did not provide the degree of safety and reliability for the various conditions encountered in operation for a typical residential furnace.

Even with the advent of substantial increases in fuel cost, draft hoods have continued in use because of the difficulties in providing a system which accomplishes all of the purposes of a draft hood in a safe and reliable manner, and which does not require an expenditure on the part of the home owner for purchase and installation, which would not be offset by the savings in the cost of fuel.

The present invention provides an ignition and control system for a furnace which eliminates the need for a conventional draft hood while, at the same time, providing a stack damper when the furnace is off, controlling the value of draft when the furnace is fired, and shutting the furnace down in the event that draft is lost during any portion of the operating cycle. All of these functions and features are accomplished in a system which is economical to purchase and install, and which has shown to be safe for residential use after analyzing all of the possible failure modes. Briefly, the present invention includes a damper plate which is movable under control between a closed and an open position. When a call for heat signal is generated, as by the closing of thermostat contacts in the room being heated by the appliance, a holding relay is actuated to energize a damper motor to open the damper, provided the damper plate was closed when the signal was generated.

That is to say, the system requires that the damper plate be in the fully closed position before an ignition cycle can commence. This insures that all major system components will have been checked for operability during the previous ignition cycle, prior to initiating a new ignition cycle.

Assuming that all components are operative, the damper is run to the full open position, and when this is proved, the fuel supply and ignition circuit is actuated to supply fuel to the appliance. At the same time, a trial-for-draft period is commenced, and a draft controller is enabled for controlling the position of the damper plate. Draft is proved through a stack transducer sensing pressure (draft) and communicating with the controller.

The draft controller actuates a first switch if draft in the flue is less than a first predetermined value, and it actuates a second switch if draft is greater than a second predetermined value higher than the first value. If draft greater than the second value is sensed within the trial-for-draft period, the draft controller moves the damper off the full open position to thereby satisfy the conditions for the trial-for-draft period and the damper is thereafter positioned by the controller. If at the end of the trial-for-draft period, the damper remains in the open position, indicating draft has not been established beyond the second value, the system shuts off the fuel and locks out.

Once draft is established during the trial-for-draft period, the predetermined draft values define a desired draft range in which the system considers draft to be normal. If draft is less than the first value, a damper motor is energized to open the damper to increase flow; and if draft is greater than the second value, the second switch energizes a damper motor to close the damper until a draft value is established within the desired draft range. Either a reversible motor can be used to actuate the damper, or, as in the case of the illustrated embodiment, separate motors can be used, each being actuated to rotate in a different direction to open and close the damper.

If neither of the draft controller switches is closed, the damper motor is de-energized, and this indicates that the draft value is within the desired range. Hence, the damper remains at rest as long as draft is within the desired range. If draft is lost, the system moves the damper to the full open position, and a loss-of-draft safety timing period commences. If draft is not re-established during this period, the system shuts off the fuel and locks itself out.

If the call for heat is satisfied, the system closes the damper and is prepared for another operating cycle, having tested the operativeness of all major components without failure. Any failure would have locked the system out. The various safety features of the system can only be understood in light of the particular circuitry of the system; and they will be described after the system is disclosed in detail. Of particular interest is the fact that no single component failure will permit a condition in which the damper plate is closed and the fuel and ignition circuit is energized.

Other features and advantages of the present invention will be apparent from the following detailed description accompanied by the attached drawing wherein identical reference numerals will refer to like parts in the various views.

THE DRAWING

FIG. 1 is a schematic diagram, partly in functional block form, of an ignition control system constructed according to the present invention; and FIG. 2 is a plan view of a damper control switch used in FIG. 1, and connected to a pressure transducer shown somewhat diagrammatically and in cross section.

DETAILED DESCRIPTION

Figure 1:
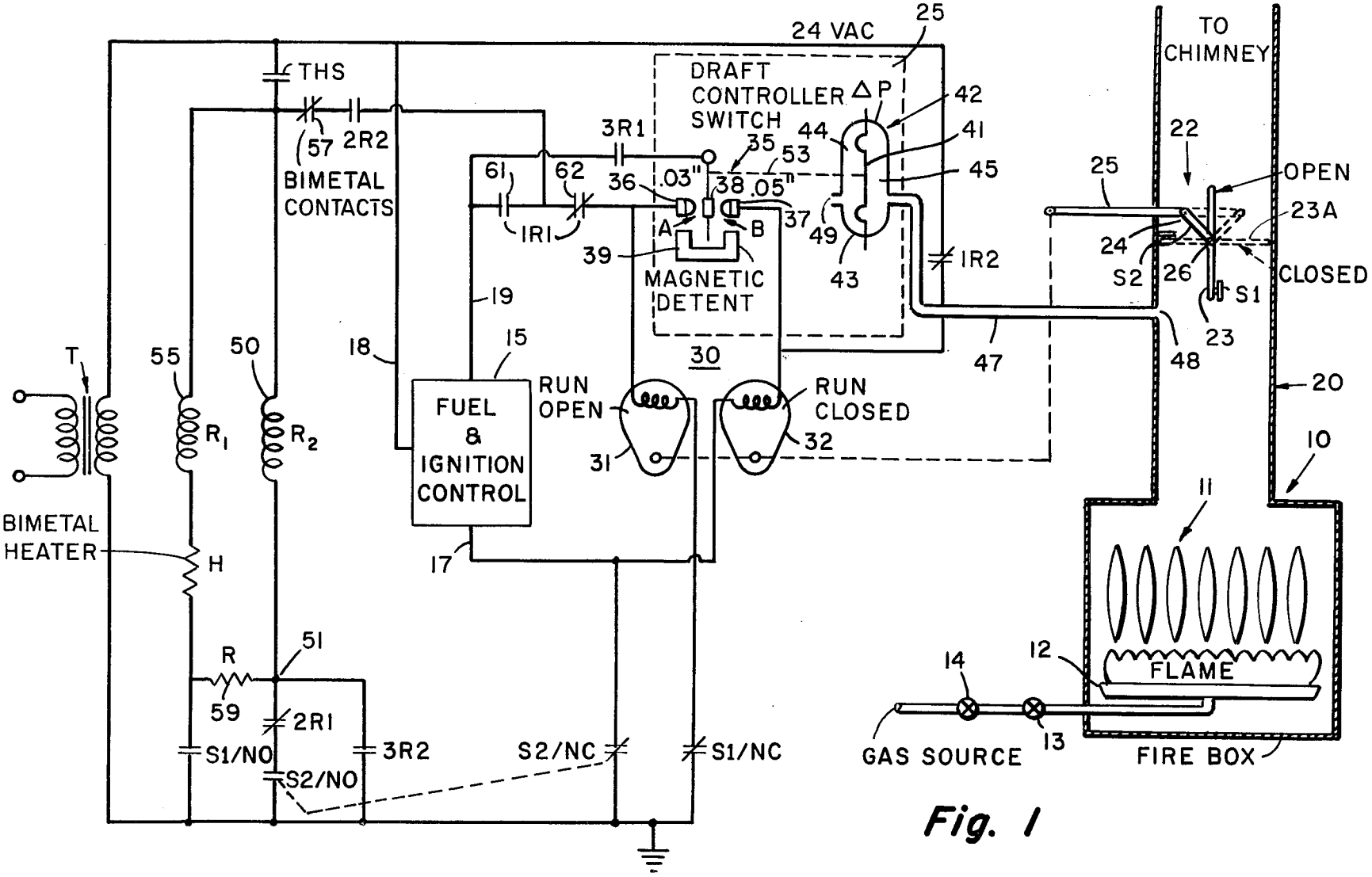

Referring first to FIG. 1, reference numeral 10 generally designates a gas-fired appliance, such as a furnace, having a heat exchanger generally designated 11, below which there is located a burner 12 supplied by a source of gas, and including at least one valve 13. A second valve 14 may also be used, in the case of ignition by means of a pilot, or it may be a redundant valve leading to the main burner.

In either case, the valve 13 leading to the burner is controlled by a fuel and ignition control circuit functionally illustrated by the block 15. The circuit 15 may be any one of a number of commercially available control circuits, for example that sold under the designation Model Q by the Penn Division of Johnson Controls, Inc., which includes a ground-interrupt lead 17, a power lead 18, and a control lead 19. This unit permits interruption of the lead 17 leading to ground; and it is designed for fuel ignition only upon a call for heat, although the invention has broad applicability to pilot ignition, direct ignition and standing pilot systems. An input transformer, T is used to supply electrical power from a conventional 60 Hertz line, having its secondary connected between the lead 18 and ground, as illustrated.

A flue pipe generally designated 20 connects the furnace 10 to the chimney, and in this connection, the term "stack" is used herein to generically refer not only to the chimney, but to all flue pipes leading to it from the furnace. Located in the flue (or other portion of the stack) is a damper generally designated 22. It includes a damper plate 23 shown in the open position in solid line and in the closed position in dashed line, as indicated by reference numeral 23A. In this embodiment, the damper plate moves back and forth between the open and closed positions, actuated by a linkage including an arm 24 and a pusher member 25. Alternatively, the damper motor could be connected to oscillate a shaft 26 on which the damper plate is mounted. In the illustrated embodiment, the pusher rod 25 is actuated by motor means generally designated 30 and including a "Run Open" motor 31, and a "Run Closed" motor 32. The motors 31, 32 are arranged to rotate in opposite directions, when actuated. They may be a Synchron Series 600 Reversible Clock Motor, manufactured by Hansen Mfg. Co., Inc. of Princeton, Ind.

A pair of limit switches designated S1 and S2 are mounted to be actuated when the damper plate 23 is in the full open and closed positions respectively. The switch S1 has associated with it a normally closed contact designated S1/NC, and a normally open contact designated S1NO. Similarly, the switch S2 has associated with it a set of normally closed contacts S2/NC and a set of normally open contacts S2/NO. The contacts S1/NC are connected between one terminal of the Run Open motor 31 and ground. The contacts S2/NC are connected between a common junction comprising the lead 17 of the fuel and ignition control 15 and the ground terminal of the Run Closed motor 32 and ground.

The other terminals of the motors 31, 32 are connected respectively to the fixed contacts of a Draft Controller Switch generally designated 35, the contacts being designated 36, 37 respectively. The switch 35 also includes a movable contact 38, having a distal end located in a conventional magnetic detent 39 to achieve a snap action in making connection with either of the contacts 36 or 37. The movable contact of the Draft Controller Switch 35 is connected to a diaphragm 41 of a pressure sensing transducer generally designated 42.

The sensor 42 includes a housing 43 in which the diaphragm 41 is connected to define two chambers designated respectively 44, 45. The chamber 45 communicates with the flue 20 by means of a conduit 47 which is coupled to the flue at an opening 48 located between the fire box of the furnace 10 and damper assembly 22.

The other chamber 44 communicates with the atmosphere by means of a port 49. As indicated, the diaphragm 41 is connected to the movable contact 38 of the controller switch 35 by means of a mechanical linkage diagrammatically illustrated by the dashed line 53.

The pressure sensing transducer 42, having one side referenced to atmospheric pressure, and the other side referenced to a location in the flue upstream of the damper assembly, senses a differential pressure representative of draft—that is, a pressure below atmospheric pressure caused by the flow of hot gases through the flue due to the stack action of the chimney. This pressure differential is converted to a displacement of the diaphragm 41. The switch 35 is set such that contacts 36 and 38 will be closed if the sensed value of draft is between atmospheric pressure and 0.03 inches of hydrostatic pressure below atmospheric, and contacts 38, 37 close if the value of draft is greater than 0.05 inches of pressure. As used herein, "draft" is expressed as a positive number, even though it is a pressure beneath atmospheric, and it is measured as the absolute value of the magnitude of pressure beneath atmospheric pressure. If the value of draft is between 0.03 and 0.05 inches, the contact 38 does not engage either of the other two contacts 36, 37. To summarize the action of the switch 35, one set of contacts (36, 38) is closed if draft is less than 0.03 inches, and the other set of contacts (37, 38) closes if the value of draft exceeds 0.05 inches. The difference between these two levels of draft defines a predetermined normal operating range in which the damper is not operated. If draft falls below the 0.03 inch level during a normal operating cycle, as will be further explained, the damper is opened; and if draft exceeds the 0.05 inch level, the damper is closed to reduce flow.

The operating levels of draft just mentioned, as well as the values defining the predetermined range may be varied, as will be described. This is important because each furnace manufacturer specifies a preferred draft value for operating his furnace, and efficient operation of the furnace can be achieved if the manufacturer's specified draft value is within the predetermined normal operating range for the Draft Controller Switch 35 in which the damper is left in a standing position.

Turning now to the left hand portion of the diagram of FIG. 1, a coil 50 of a holding relay R2 is connected to conventional thermostat contacts THS of a thermostat located in the room to be heated. The other terminal of the contacts THS is connected to the secondary of the transformer T. The other terminal of the coil 50 is connected to a junction 51. A set of normally closed contacts 2R1 and normally open contacts S2/NO are connected in series between ground and the junction 51. A pair of normally open holding contacts 3R2 is also connected between the junction 51 and ground across the series circuit just described.

A coil 55 of a relay R1, sometimes referred to as the "enabling" relay because one of its functions is to enable the pressure transducer to interface with the fuel and ignition control circuit 15, is connected between the thermostat contacts THS and a bimetal heater element H, which has associated with it a pair of normally closed bimetal contacts 57. If the heater element H is energized with a predetermined voltage for a known length of time, the bimetal contacts 57 will open; and this length of time defines a trial-for-draft period. On the other hand, the heater element H may be energized continuously with a lower level of current (sufficient to hold the relay R1 actuated, but insufficient to initially actuate it), without causing the contacts 57 to open.

The other terminal of the bimetal heater element H is connected to a resistor 59 and a set of normally open contacts S1/NO. The other terminal of the resistor 59 is connected to the junction 51; and the other terminal of the contacts S1/NO is connected to ground.

The enabling relay R1 has four sets of contacts associated with it. One pair of sets of contacts, designated respectively 61, 62 are normally open and normally closed respectively; and they are mechanically tied together, and generically designated 1R1. The normally closed contacts 62 are connected between a normally open set of contacts 2R2 associated with relay R2, and a junction between the fixed contact 36 of the Draft Controller Switch 35 and a terminal of the Run Open Motor 31. The normally open contacts 61 are connected between the contacts 62 and the control input lead 19 of the Fuel and Ignition Control Circuit 50.

A third set of contacts associated with the enabling relay R1 are located in the lower left hand corner of the drawing, and designated 2R1. These are normally closed contacts referred to above. A fourth set of contacts, normally open, is designated 3R1, and these contacts are connected between the lead 19 and the movable contact 38 of the Draft Controller Switch 35.

The holding relay R2 has associated with it, a set of normally closed contacts 1R2 connected between the secondary of the transformer T, and an input terminal of the Run Closed Motor 32.

Figure 2:
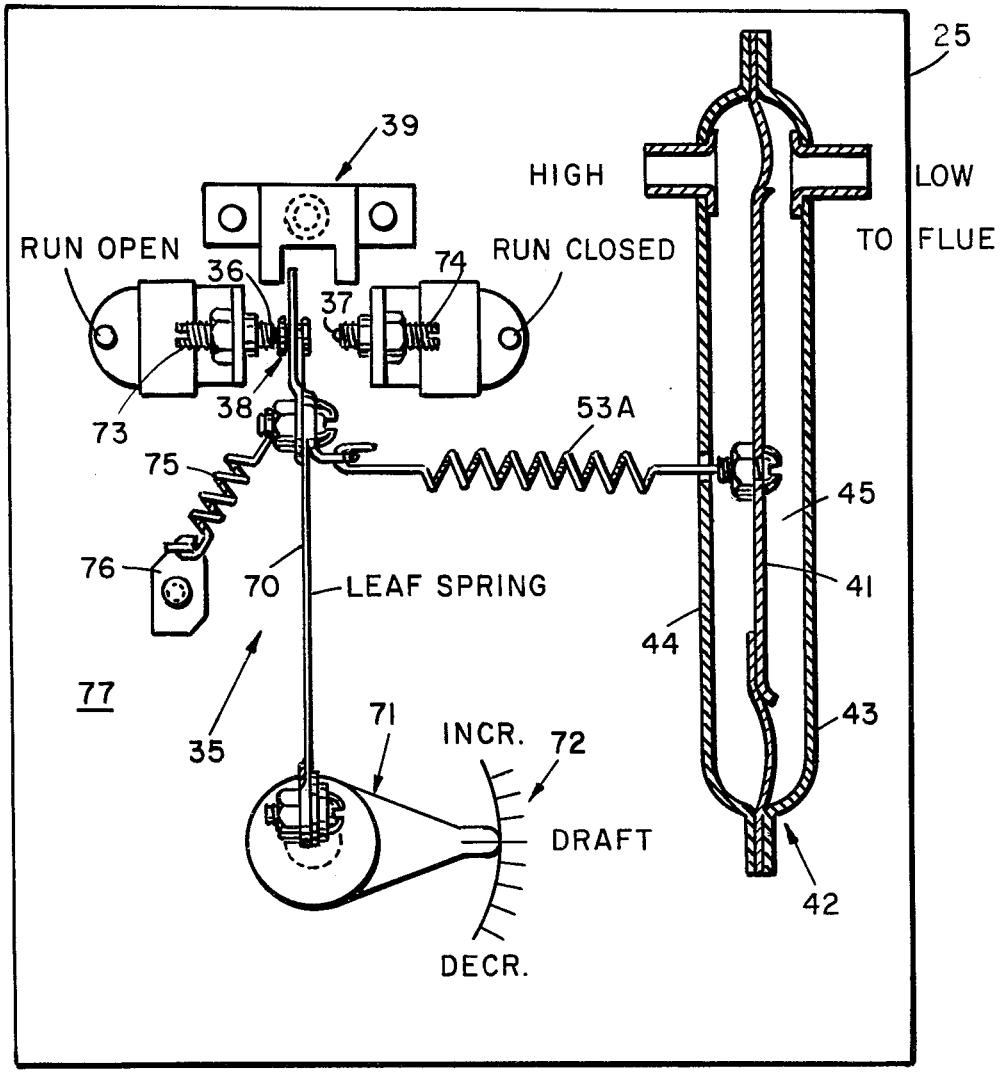

Referring now to FIG. 2, there is shown a more structural view of the pressure sensing element 42 having its diaphragm 41 connected by means of a coil spring 53A to a leaf spring 70. One end of the spring 70 is connected to a set point adjusting mechanism generally designated 71 and having associated with it a scale 72 indicating the value of draft set point. The other end of leaf spring 70 contains the previously identified contact 38 which, as illustrated, may comprise two oppositely-facing contact points adapted to contact the fixed contacts 36, 37 respectively. The contacts 36, 37, as indicated, are connected respectively to the input terminals of the Run Open and Run Closed Motors 31, 32; and the position of these contacts may be adjusted by means of the set screws 73, 74 respectively. The magnet 39 is a weak magnet producing a slight detent action of the switch contacts to prevent contact chatter.

A flexible conductor 75 is connected between the leaf spring 70 and a fixed terminal 76 attached to a base 77 for coupling electrical power to the movable contact. The setting of the set point adjusting mechanism 71 establishes what force is required to be exerted by spring 53A and diaphragm 41 to contacts 36, 38 and to close contacts 38, 37. This force is directly related to the draft sensed in chamber 45 and, therefore, is the draft set point.

OPERATION

When the thermostat contacts THS are open, indicating that heating requirements have been satisfied, under normal operating conditions, the coil 50 of the holding relay R2 is de-energized, and the Run Closed Motor 32 will have been actuated through normally closed contacts 1R2 and S2/NC to rotate the damper plate 23 to the fully closed position, at which time the switch S2 is actuated and the contacts S2/NC are opened, to de-energize the motor 32. This also insures that the Fuel and Ignition Control Circuit 15 cannot be energized when the damper plate is in the closed position.

When the thermostat generates a call for heat signal, by closing the contacts THS, the coil 50 of the holding relay R2 is energized through normally closed contacts 2R1, provided the switch S2 is actuated, indicating that the damper plate is closed. For reasons to be indicated below, it is considered an important safety feature of the illustrated system that an operating cycle cannot commence unless the damper plate is in the closed position. This insures that the system will have operated a complete cycle, testing all major elements of the system.

When the coil 50 is energized, contacts 3R2 close, thereby holding the relay R2 energized until the contacts THS open, indicating that the heat requirements have been satisfied. At the same time, contacts 2R2 close, thereby communicating power from the secondary of transformer T to the junction between contacts 61, 62, associated with the enabling relay R1. Because contacts 62 are normally closed, a "Run Open" signal will be applied to the Motor 31 through the normally closed contacts S1/NC (since the damper will have been closed in normal operation). The damper is thus driven to the full open position shown in solid line to actuate the switch S1. When the switch S1 is actuated, the contacts S1/NC open, thereby interrupting the ground lead of the Run Open Motor 31. Prior to this time, it will be appreciated that the Draft Controller Switch 35 is not effective to operate either of the motors 31, 32, or the Fuel and Ignition Control Circuit 15 because the contacts 3R1 and 61 are both open.

After the damper plate has been driven to the fully open position, and switch S1 is actuated, the contacts S1/NO are closed, thereby energizing the series circuit comprising the coil 55 of relay R1 and the bimetal heater H. Although current had been flowing through this circuit, it was limited by the value of resistor 59 to a current insufficient to pull in the relay R1 and insufficient to actuate the bimetal contacts 57. When the contacts S1/NO close, however, sufficient current flows through the coil 55 to actuate the relay R1, and also to begin a trial-for-draft period. When R1 is energized, an ignition cycle is also started as the contacts 61 close and supply energy on lead 19 to the control input of the Fuel and Ignition Control Circuit 15, the ground lead 17 of which is connected to ground through contacts S2/NC provided the damper plate is not closed. At the same time, contacts 3R1 close, thereby coupling input power to the movable contact 38 of the Draft Controller Switch 35.

Typically, with the damper in the full open position, the temperature difference between the ambient of the appliance and the outside will establish a draft due to stack action of the chimney. This draft will normally be increased when the fuel is ignited. This draft is sensed through the opening 48 and communicated to the pressure sensing means 42 through conduit 47. Because the damper plate is fully open when the flame is first ignited, a draft will be produced which is greater than the normal operating range defined by the switch 35; and the contacts 38, 37 will close. This will generate a "Run Closed" signal to energize the Motor 32, and thereby cause the damper plate to run toward the closed position until draft falls below the higher predetermined level defining the desired draft range (which in the exemplary embodiment is a 0.05 inch level). At this time, the contacts 37, 38 disengage, and the Run Closed Motor 32 is de-energized, leaving the damper plate in an intermediate position between fully open and fully closed.

During a normal operating cycle, the damper plate will be at the full open position only momentarily and the Run Closed Motor 32 will be energized before the trial-for-draft period terminates—that is, before sufficient heat is generated by the bimetal heater H to open the contacts 57. When the damper is driven off the full open position, the contacts S1/NO again open, thereby decreasing the current through the coil 55 of relay R1 and the bimetal heater H (so that contacts 57 will not be actuated), but leaving sufficient current flowing through resistor 59 to maintain the relay R1 in an energized state. As the damper is driven toward the closed position, the draft is decreased and this is sensed by transducer 42 immediately. Typically, when the damper is half closed, the sensed draft will be less than the higher predetermined value (0.05 in.) and the Run Closed Motor 32 will be de-energized.

When a call for heat has been satisfied, the contacts THS open, thereby de-energizing the coils of relays R1 and R2 simultaneously; and when relay R2 is de-energized, contacts 1R2 close to generate a "Run Closed" signal to energize Motor 32 through contacts S2/NC until the damper plate is closed and the switch S2 is actuated. The system is then at rest and prepared for another complete operating cycle.

To summarize the operation of the damper, when THS calls for heat, holding relay R2 is energized to generate a "Run Open" signal only if the damper is closed (S2/NO). Upon the damper's reaching the open position, enabling relay R1 energizes the fuel control circuit and turns operation of the damper over to the Damper Controller Switch 35 which generates a "Run Closed" signal when contacts 37, 38 close and a "Run Open" signal when contacts 36, 38 close. When THS opens, and the holding relay R2 is de-energized, a "Run Closed" signal is generated by the closing of contacts 1R2.

It will be observed from the above that during a normal operating cycle, the damper plate must be in the closed position to start a cycle, and be run to a fully open position before fuel can be supplied to the appliance.

If draft is lost during an operating cycle, then the contacts 36, 38 close to energize the Run Open Motor 31 until the damper plate reaches the fully open position, at which time the Motor 31 is de-energized by the opening of the contacts S1/NC. At the same time, the contacts S1/NO close, thereby increasing the current to the operating level in the bimetal heater H. If draft is not established within the design range defined by the Draft Controller Switch 35, the bimetal contacts 57 will open, thereby deactuating the Fuel and Ignition Control Circuit 15 and shutting off the flow of fuel to the burner. The system locks out until it is re-cycled. This may be accomplished externally, or by including a reset switch, or by cycling the thermostat control.

The present system thus eliminates any need for a draft hood because draft is controlled directly by controlling the position of the damper plate 23. Further, more efficient operation of the furnace is provided by controlling the value of draft which controls the flow of air through the fire box. The system also provides loss-of-draft safety, as just explained. Still further, the system closes the damper plate 23 when the furnace is off, to eliminate any vent losses during off cycles. All of these features are provided in a system which is safe not only in normal operation, but which does not create any unsafe condition even though one or more components may fail.

SAFETY FEATURES

Because the present invention is intended primarily for residential use, complete safety and economy are two very important considerations. Interlocking of the holding relay R2 and the enabling relay R1 with the normally open contacts of the damper switches S1 and S2 insure that the damper will be driven to a fully closed position if the cycle is interrupted at any point (and the supply of fuel will be discontinued), and the damper plate must then be driven from the fully closed to the fully open position before trial for draft. This tests all of the primary electrical and mechanical elements for operativeness. The holding relay R2 cannot be energized if limit switch S2 is not actuated (by the closing of the damper); and thus, an operating cycle may not be started. If contacts S2/NO are welded closed, then contacts S2/NC (which are tied to contacts S2/NO) cannot close. Thus, the Run Closed Motor 32 and the Fuel and Ignition Control Circuit 15 cannot be energized. If contacts 2R2 weld closed, the associated contacts 1R2, to which a mechanical tie is made, cannot be closed, and the Run Open Motor 31 runs to full open, actuates limit switch S1, but the damper plate cannot be moved from the full open position, and the bimetal heater element H heats until the contacts 57 are open, and the system is in lockout.

The draft controller switch 35 can fail in either position without hazard, also. If the contact 38 welds to the contact 36, the damper will run open and stop when switch S1 is activated, thereby causing the bimetal heater to heat to lockout. If the contact 38 welds to contact 37, the damper will run to the closed position whenever R1 is energized, and the Fuel and Ignition Control Circuit 15 will be interrupted. Thus, the draft control switch may be any other type of controlling switch since it may fail in either position. For example, it could be a light-emitting diode and a pair of phototransistors alternately eclipsed by a diaphragm-operated blade.

Having thus disclosed in detail a preferred embodiment of the invention, persons skilled in the art will be able to modify certain of the structure which has been illustrated and to substitute equivalent elements for those disclosed while continuing to practice the principle of the invention. For example, a single two-phase motor with permanent split capacitor could be substituted for the separate motors 31, 32, and perform the same function. Further, the damper might be used as a controller for combustion for secondary air, in which case, it could be located to control the flow of air into the fire box, rather than to control the discharge of flue gases, as in the illustrated embodiment. In this case, the port 49 of the pressure sensing means 42 could be referenced to the pressure at the combustion air inlet. In both cases, what is being controlled is the flow of combustion air through the furnace by sensing a differential pressure across the fire box. Still further, a snubber or other mechanical closure could be actuated at the end of a combustion cycle to insure air-type closure of the damper plate in the illustrated embodiment. This would reduce even further any loss of heat through the chimney. It is thus intended that all such modifications and substitutions be covered as they are embraced within the spirit and scope of the appended claims.

I claim:

1. In combination with a furnace having a firebox and adapted to be connected to a source of fuel by means of fuel control means, a movable element movable between a closed and an open position for controlling the flow of air through a firebox of said furnace, and a thermostat for generating a call for heat signal from a space to be heated by said furnace, the improvement comprising: flue means for communicating combustion gases from said firebox to a chimney and substantially free of losses to the atmosphere between said firebox and chimney; motor means responsive to a run open signal for operating said movable element toward said open position and responsive to a run closed signal for operating said element toward said closed position; first limit switch means actuated when said movable element is in said open postion; second limit switch means actuated when said movable element is in said closed position; holding circuit means responsive to a call for heat signal only when said second limit switch means is actuated for generating an initial run open signal to said motor means; controller means including pressure sensing means responsive to the pressure in said flue means for generating a run open signal when the draft in said flue means is less than a first predetermined value, and for generating a run closed signal when the draft in said flue means is greater than a second predetermined value, said controller means generating neither of said signals when the draft is between said first and second predetermined values; enabling circuit means responsive to the actuation of said first limit switch means when said movable element is in said open position for interrupting said initial run open signal and for then enabling said controller means to couple said run open and run closed signals to said motor means, and for energizing said fuel control means; timing means for actuating timing switch means a predetermined time after said timing means is energized, said timing means being connected in circuit with said enabling circuit means to be energized when said enabling circuit means is energized, said timing switch means being connected in circuit with said thermostat contacts and said controller means to de-energize said controller means and said fuel control circuit said predetermined time after said timing means is energized if said timing means is not de-energized in said predetermined time; said first limit switch means deactuating said timing circuit means when said movable element is moved from said fully open position in response to the establishment of a normal draft.

2. The apparatus of claim 1 wherein said movable element is a damper element and further comprising holding contacts actuated by said holding circuit means for maintaining said holding circuit means actuated after said second limit switch is deactuated for as long as said call for heat signal is generated; and resistive holding means connecting said enabling circuit means in circuit with said holding contacts for maintaining said enabling circuit means energized after it has been actuated; and normally open switch means actuated by said first limit switch means connected in circuit with said enabling circuit means for actuating said enabling circuit means when said damper is moved from the closed position to the open position upon initiation of a heating cycle.

3. The apparatus of claim 1 wherein said enabling circuit means comprises a relay having a coil connected in circuit with said thermostat contacts, said timing means and a normally open contact of said first limit switch means, whereby said coil is energized only after said damper element is fully open, said enabling relay further including contact means for coupling the output signals of said controller means to said motor means, and for actuating said fuel control means after said damper element is in the full open position, said timing circuit means being operative to de-energize said relay of said holding circuit means a predetermined time after said relay is energized if said damper element does not move from said full open position within said predetermined time.

4. The apparatus of claim 3 wherein said enabling relay further includes normally closed contacts connected in circuit with said holding circuit means for rendering said holding circuit means nonresponsive to the actuation of said second limit switch means when said enabling circuit means is energized.

5. The apparatus of claim 1 wherein said motor means comprises a run open motor responsive to said run open signal to move said element to the open position; and a run closed motor responsive to said run closed signal to move said element to the closed position, said first limit switch means including a set of normally closed contacts for de-energizing said run open motor when said element is in the open position; said second limit switch means comprising a set of normally closed contacts for deenergizing said run closed motor and said fuel control circuit when said element is in the closed position.

6. In combination with a furnace havine a firebox and adapted to be connected to a source of fuel by means of fuel control means, a damper element movable between a closed and an open position for controlling the flow of air through a firebox of said furnace, and a thermostat for generating a call for heat signal from a space to be heated by said furnace, the combination comprising: flue means for communicating combustion gases from said firebox to a chimney and substantially free of losses to the atmosphere between said firebox and chimney; motor means responsive to a run open signal for operating said movable element toward said open position and responsive to a run closed signal for operating said element toward said closed position; first limit switch means actuated when said damper element is in said open position; said limit switch means actuated when said damper element is in said closed position; holding circuit means responsive to a call for heat signal only when said second limit switch means is actuated for generating an initial run open signal to said motor means; controller means including pressure sensing means responsive to the pressure in said flue means for generating a run open signal when the draft in said flue means is less than a first predetermined value, and for generating a run closed signal when the draft in said flue means is greater than a second predetermined value, said controller means generating neither of said signals when the draft is between said first and second predetermined values; enabling circuit means responsive to the actuation of said first limit switch means when said damper element is in said open position for interrupting said initial run open signal and for coupling said run open and run closed signals of said controller means in operative relation with said motor means, and for energizing said fuel control means, and timing circuit means for de-energizing said fuel control circuit a predetermined time after said first limit switch means is actuated in response to said element's being in the open position if said element remains in said open position for said predetermined time.

7. In combination with a furnace having a firebox and adapted to be connected to a source of fuel by means of fuel control means, a movable element movable between a closed and an open position for controlling the flow of air through a firebox of said furnace, and a thermostat for generating a call for heat signal from a space to be heated by said furnace, the improvement comprising: flue means for communicating combustion gases from said firebox to a chimney and substantially free of losses to the atmosphere between said firebox and chimney; motor means responsive to a run open signal for operating said movable element toward said open position and responsive to a run closed signal for operating said element toward said closed position; first limit switch means actuated when said movable element is in said open position; second limit switch means including first contacts actuated only when said movable element is in said closed position; circuit means connected in circuit with said first contacts and responsive to a call for heat signal only when said second limit switch means is actuated by said movable element at said closed position for generating an initial run open signal to said motor means; controller means including pressure sensing means responsive to the pressure in said flue means for generating a run open signal when the draft in said flue means is less than a first predetermined value, and for generating a run closed signal when the draft in said flue means is greater than a second predetermined value, said controller means generating neither of said signals when the draft is between said first and second predetermined values; enabling circuit means responsive to the actuation of said first limit switch means which said movable element is in said open position for interrupting said initial run open signal and for then enabling said controller means to couple said run open and run closed signals to said motor means, and for energizing said fuel control means.

8. The apparatus of claim 7 wherein said second limit switch means further includes second contacts mechanically interlocked to said first contacts thereof and connected in circuit with said fuel control means to inhibit actuation thereof when said movable element is in said closed position.

* * * * *